US011277684B2

(12) United States Patent
Kitagawa et al.

(10) Patent No.: US 11,277,684 B2
(45) Date of Patent: Mar. 15, 2022

(54) DIFFUSER

(71) Applicant: Onkyo Corporation, Osaka (JP)

(72) Inventors: Norimasa Kitagawa, Osaka (JP); Mitsuhiko Tokuda, Tokyo (JP); Yoshinori Nakanishi, Osaka (JP); Ryuta Shigematsu, Tokyo (JP); Koichi Sadaie, Osaka (JP); Yoshitada Takeshima, Osaka (JP)

(73) Assignee: Onkyo Corporation, Osaka (JP)

( * ) Notice: Subject to any disclaimer, the term of this patent is extended or adjusted under 35 U.S.C. 154(b) by 260 days.

(21) Appl. No.: 16/733,020

(22) Filed: Jan. 2, 2020

(65) Prior Publication Data

US 2020/0236462 A1 Jul. 23, 2020

(30) Foreign Application Priority Data

Jan. 17, 2019 (JP) ..... JP2019-005752
Apr. 19, 2019 (JP) ..... JP2019-079985
Oct. 4, 2019 (JP) ..... JP2019-183562

(51) Int. Cl.

| | |
|---|---|
| ***H04R 1/28*** | (2006.01) |
| ***H04R 1/34*** | (2006.01) |
| ***G10K 11/20*** | (2006.01) |
| ***H04R 7/12*** | (2006.01) |
| ***H04R 9/04*** | (2006.01) |
| ***H04R 9/06*** | (2006.01) |

(52) U.S. Cl.

CPC ..... *H04R 1/345* (2013.01); *G10K 11/20* (2013.01); *H04R 7/12* (2013.01); *H04R 9/045* (2013.01); *H04R 9/06* (2013.01)

(58) Field of Classification Search

CPC ..... H04R 1/28
USPC ..... 381/160, 337
See application file for complete search history.

(56) References Cited

U.S. PATENT DOCUMENTS

| | | | | |
|---|---|---|---|---|
| 1,952,239 A | | 3/1934 | Douw | |
| 2,591,946 A | | 2/1951 | Stark | |
| 3,816,672 A | * | 6/1974 | Gefvert | H04R 1/345 381/352 |
| 4,063,387 A | * | 12/1977 | Mitchell | A01G 9/02 47/67 |
| 5,086,871 A | * | 2/1992 | Barbe | H04R 1/345 181/145 |
| 5,115,882 A | * | 5/1992 | Woody | H04R 1/345 181/144 |

(Continued)

FOREIGN PATENT DOCUMENTS

| | | |
|---|---|---|
| JP | S55-013592 A | 1/1980 |
| JP | S56-041431 Y | 9/1981 |

(Continued)

*Primary Examiner* — Suhan Ni
(74) *Attorney, Agent, or Firm* — Renner, Otto, Boisselle & Sklar, LLP

(57) ABSTRACT

A diffuser which forms a first acoustic passage that sound waves propagate and which radiates the sound waves to an outer diameter direction between a diaphragm and an annular conical surface of a first reflection member, and forms a second acoustic passage the sound waves which pass the opening of the first reflection member propagate and which radiates the sound waves to an outer diameter direction between the annular concave surface of the first reflection member and a conical surface of a second reflection member.

13 Claims, 10 Drawing Sheets

(56) References Cited

U.S. PATENT DOCUMENTS

| | | | | |
|---|---|---|---|---|
| 5,220,608 | A | 6/1993 | Pfister | |
| 6,996,243 | B2 * | 2/2006 | Welker | H04R 1/02 381/160 |
| 2005/0008173 | A1 * | 1/2005 | Suzuki | H04R 1/345 381/160 |
| 2016/0227315 | A1 | 8/2016 | Kim | |

FOREIGN PATENT DOCUMENTS

| | | | |
|---|---|---|---|
| JP | S64-047189 | U | 3/1989 |
| JP | H03-024898 | A | 2/1991 |
| JP | 4646765 | B | 12/2010 |
| JP | 2018-504056 | A | 2/2018 |

* cited by examiner

DIFFUSER

CROSS-REFERENCE TO RELATED APPLICATIONS

This application claims priority to Japanese Application No. 2019-005752, filed Jan. 17, 2019, Japanese Application No. 2019-079985, filed Apr. 19, 2019, and Japanese Application No. 2019-183562, filed Oct. 4, 2019, the entire contents of which are incorporated herein by reference.

FIELD

The present disclosure relates to a diffuser which is arranged to face to a diaphragm of a speaker which radiates sound waves and realizes nondirectional characteristics by radiating the sound wave to an outer diameter direction.

BACKGROUND

An electrodynamic type speaker which has a diaphragm radiates sound waves by vibrating tends to become nondirectional characteristics that sound pressure level is almost uniform to an outer diameter direction in low frequency band that wavelength of the radiated sound waves which is relatively long against a diaphragm diameter. On the other hand, in high frequency band wavelength of the radiated sound waves which is relatively short against the diaphragm diameter, sound pressure of the sound waves which is radiated to a front face direction that the diaphragm vibrates is high and the electrodynamic type speaker is easy to have directional characteristics that sound pressure of the sound waves which are radiated to a side face direction becomes low.

Since, in a normal speaker system that a speaker is mounted to a cabinet, radiation characteristics tends to have directional characteristics, there is a problem that reproduction sound quality changes depending on a direction of the speaker against a listener. Therefore, there is conventionally a one to change directional characteristics of radiation of sound waves by providing a diffuser which is mounted to face to the diaphragm of the speaker. For example, a diffuser which changes to nondirectional characteristics includes an almost cone-shaped reflector which reflects sound waves which are radiated from a diaphragm (JP S56-041431 Y (FIG. 1.)). There is also a case where a diffuser which is a reflector is called a reflector.

There are various speakers which have a diffuser to realize nondirectional characteristics. In case of a full range speaker, a one which includes an almost cone-shaped reflector which is arranged to face to a diaphragm is typical. Further, in a multiway speaker system which divides reproduction frequency band and is composed of a plurality of speakers, there is a case where realization of nondirectional characteristics in all band is devised by providing a diffuser at a full range speaker which reproduces middle and high sound band, a squawker or a tweeter. A woofer which reproduces low sound band which becomes close to nondirectional characteristics is only mounted to a cabinet, and there is a case where a diffuser is not provided at the woofer.

A shape of a diffuser which corresponds to a shape of a diaphragm of a speaker and arrangement relationship of them influence quality of reproduced audio and sound pressure frequency characteristics. Especially, there is a problem that large peak tends to appear on sound pressure frequency characteristics by resonance which is easy to occur in a space between a diaphragm of a speaker and a diffuser. Further, especially, in case of a full range speaker, since frequency band of radiated sound waves is broad, there is a problem that it is difficult to handle from low frequency that wavelength is long to high frequency that wavelength is short by a reflector.

Conventionally, there is a carillon type speaker which stores a speaker on a top part of a bell type enclosure, forms an annular opening of a horizontal direction at a peripheral wall part of the enclosure, and forms an acoustic guide for guiding sound from the speaker to the annular opening in an inside of the enclosure (JP S64-047189 U). Further, conventionally, there is an omnidirectional radiation device of acoustic waves that sources of acoustic waves which have higher frequency than upper limit of a woofer are arrayed on the same surface and which radiates a sound signal to a vertical direction against this surface along a reflected/diffracted system (JP S55-013592 A).

Further, there is a nondirectional acoustic deflector which includes an acoustic reflector which has a truncated cone shape including an outer surface, an upper surface, and a cone axis of an almost cone shape and has an opening part of the upper surface of which center is positioned at the cone axis and a sound absorbing material which is arranged at the opening of the upper surface (JP 2018-504056A). Further, in an electronic musical instrument, there is a one which sounds a musical sound to a lateral side of the electronic musical instrument by sounding the musical sound from the speaker downward in a speaker box and diffusing the sounded musical sound by a diffuser, for example (JP 4646765 B (FIG. 9)).

SUMMARY OF THE DISCLOSURE

According to one aspect of the disclosure, there is provided a diffuser which is arranged to face to a diaphragm of a speaker which radiates sound waves comprising: an opening that a center axis which defines a direction the diaphragm vibrates passes and which defines an inner diameter size; an almost truncated cone shaped first reflection member which has an annular conical surface which faces to the diaphragm and an annular concave surface which is formed at an opposite side of the annular conical surface, and; an almost cone shaped second reflection member which is arranged close to the first reflection member and has a conical surface that the center axis passes a vertex of the conical surface, wherein the diffuser forms a first acoustic passage that the sound waves propagate and which radiates the sound waves to an outer diameter direction between the diaphragm and the annular conical surface of the first reflection member and forms a second acoustic passage the sound waves which pass the opening of the first reflection member propagate and which radiates the sound waves to an outer diameter direction between the annular concave surface of the first reflection member and the conical surface of the second reflection member.

DETAILED DESCRIPTION OF THE PREFERRED EMBODIMENTS

The disclosure is done for solving a problem that the above described conventional technology has, an objective of the present disclosure is to provide a diffuser which prevents that a large peak appears on sound pressure frequency characteristics by resonance which is easy to generate in a space between a diaphragm of a speaker and a diffuser, lightens nonuniformity of directional characteristics by frequency, and also corresponds to a full range speaker that frequency band of radiated sound waves is broad, a speaker including the diffuser, and an electronic musical instrument.

A diffuser, a speaker including the diffuser, and an electronic musical instrument according to preferable embodiments of the present disclosure is described below. However, the present disclosure is not limited to these embodiments.

Embodiment 1

Figure 1:
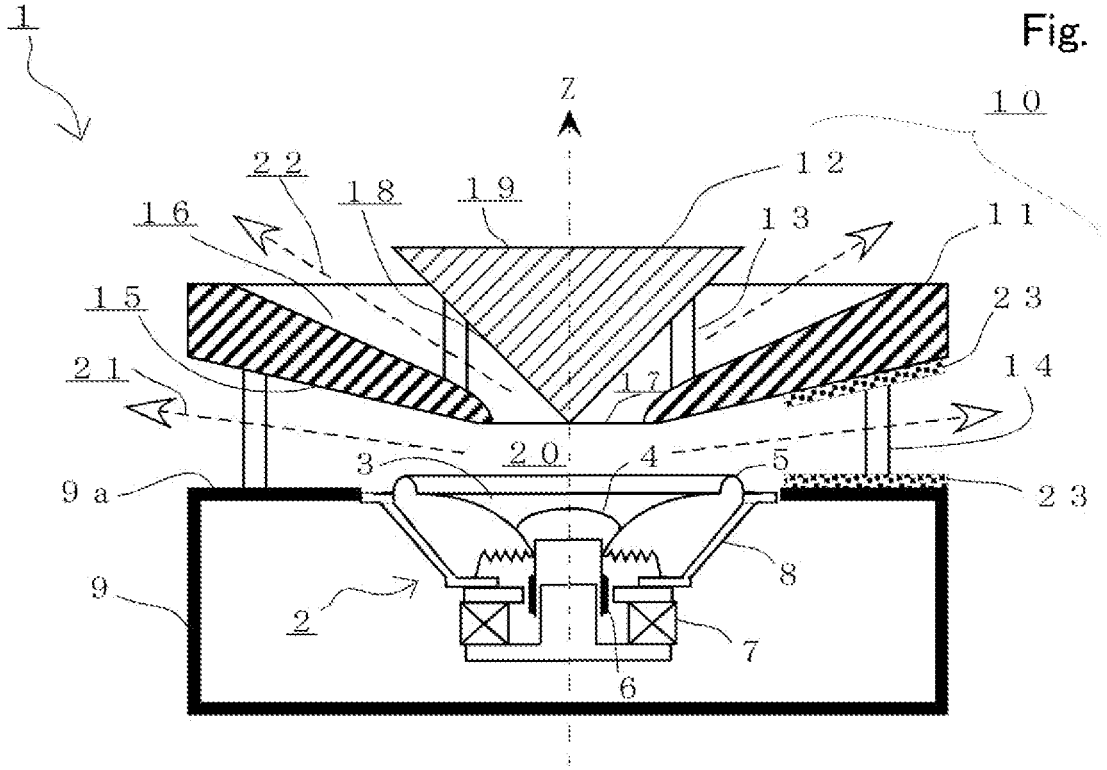
FIG. 1 is a cross sectional diagram for describing a diffuser and a speaker including the diffuser according to one embodiment of the present disclosure.
Figure 2:
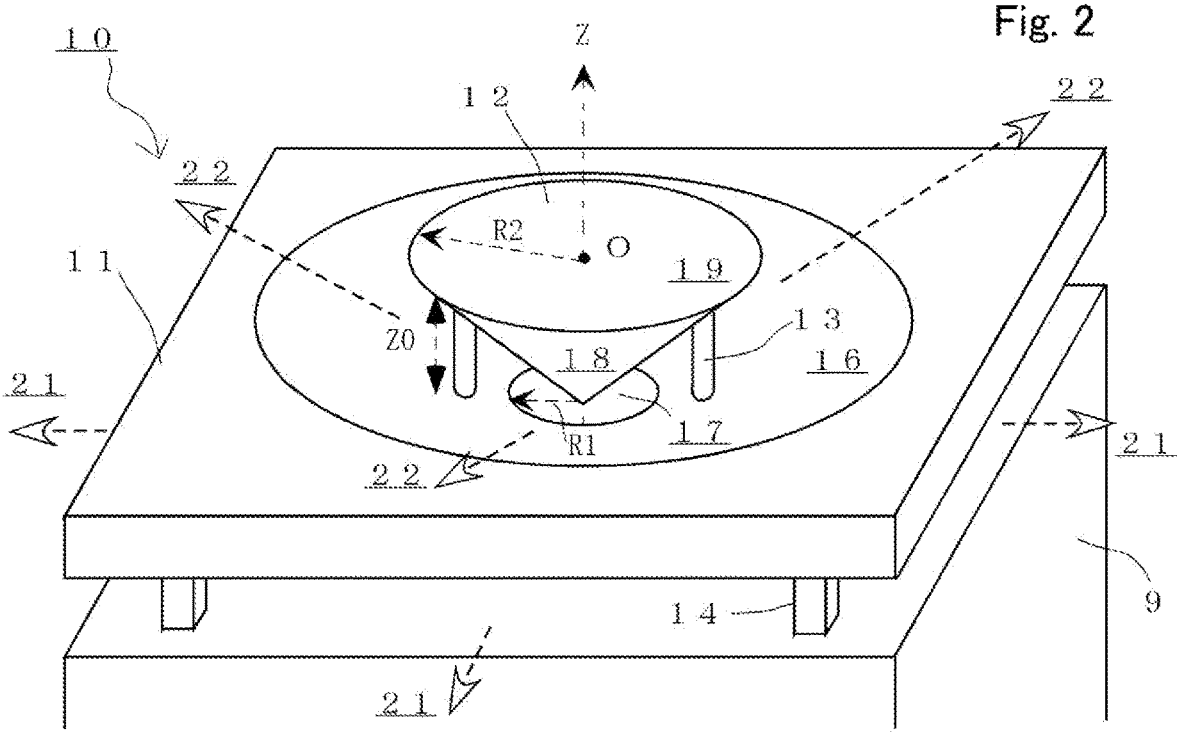
FIG. 2 is a perspective diagram for describing the diffuser according to one embodiment of the present disclosure.

Each of FIG. 1 and FIG. 2 is a diagram for describing a diffuser and a speaker including the diffuser according to a preferable embodiment of the present disclosure. Concretely, FIG. 1 is a cross sectional diagram of a speaker 1 including a diffuser 10. Further, FIG. 2 is a perspective diagram of this diffuser 10 in view from a front surface upper side. Configurations of the diffuser 10 and the speaker 1 are not limited to a case of the present embodiment. Further, with regard to unnecessary configurations of the diffuser 10 and the speaker 1 for description of the present disclosure, illustration and description are omitted.

The speaker 1 of the present embodiment is a nondirectional speaker system that the diffuser 10 is mounted to face to a diaphragm 3 of a speaker unit 2 and which realizes nondirectional characteristics. The speaker unit 2 includes the cone type diaphragm 3 and is a full range type electrodynamic type speaker which reproduces all bands from low frequency to high frequency.

In the direct radiation type speaker unit 2 alone, sound pressure of sound waves which are radiated to a direction that the diaphragm 3 vibrates in middle and high sound band becomes high, and the speaker is easy to have directional characteristics that sound pressure of sound waves which is radiated to a side face direction becomes low. Therefore, the speaker 1 of the present embodiment is designed to become nondirectional characteristics with regard to a horizontal direction which is orthogonal to a Z axis by arranging the diaphragm 3 of the speaker unit 2 toward an upper side (an illustrated Z axis direction) and providing the diffuser 10 to face to the diaphragm 3.

The speaker unit 2 is an electrodynamic type speaker which includes the cone type diaphragm 3 in which cross sectional surface is a concave shape. Since a bobbin of a voice coil 6 is connected to an inner diameter part of the diaphragm 3, a dust cap 4 in which cross sectional surface is a convex shape is mounted to cover the inner diameter part. An inner diameter side of a flexible edge 5 is mounted to an outer diameter part of the diaphragm 3, and the edge 5 supports a diaphragm part including the diaphragm 3 which radiates sound waves and the dust cap 4 to be able to vibrate with a damper. A coil which is wound to the bobbin of the voice coil 6 is arranged at a magnetic space of a magnetic circuit 7. A frame 8 is connected to the outer diameter side of the edge 5 and the magnetic circuit 7.

Therefore, in the speaker unit 2, when an audio signal current is supplied to the coil of the voice coil 6 which is arranged in the magnetic space of the magnetic circuit 7 that a strong DC magnetic field generates, a driving power generates to an illustrated Z axis direction and a speaker vibration system which is composed of the voice coil 6, the diaphragm 3, and the dust cap 4 vibrates to a Z axis direction. As a result, pressure change generates in an air which exists in front and rear of the diaphragm 3 and the dust cap 4, and the audio signal current is changed to sound waves (audio).

The frame 8 of the speaker unit 2 is mounted to an opening part of amounting surface 9*a* which is provide at an upper surface side of the cabinet 9. The cabinet 9 of the present embodiment is a sealed type cabinet which functions as a baffle which divides one surface side and the other surface side of the diaphragm 3 acoustically. However, the cabinet 9 may be a phase inversion type (bass reflex type) cabinet that acoustic capacitance which is defined by an inside of the cabinet and acoustic mass of a duct resonate or the like.

The diffuser 10 is further provided on the mounting surface 9*a* of the upper surface side of the cabinet 9 to face to the diaphragm 3 of the speaker unit 2 which radiates sound waves. As illustrated in FIG. 1 and FIG. 2, the diffuser 10 is composed by combining two reflection members. Concretely, the diffuser 10 includes a first reflection member 11 including an almost truncated cone shaped part and an almost cone shaped second reflection member 12.

The first reflection member 11 and the second reflection member 12 are connected by a connection member 13. Further, the first reflection member 11 and the cabinet 9 are connected by a connection member 14. The connection member 14 connects the first reflection member 11 and the cabinet 9 so that the diaphragm 3 of the speaker unit 2 which displaces to project to maximum by vibrating at least and the dust cap 4 do not contact to the diffuser 10 and the first reflection member 11 and the cabinet 9 are separate.

The first reflection member 11 has a substrate which has an annular conical surface 15 which faces to the diaphragm 3 and an annular concave surface 16 which is formed at an opposite side of this annular conical surface 15. The first reflection member 11 further has an opening 17 that a Z axis which is a center axis which defines a direction that the diaphragm 3 vibrates passes and which defines an inner diameter size. Further, in the present embodiment, in the first reflection member 11, an outer shape is an almost square, an outer diameter size is larger than an outer diameter size of the diaphragm 3, and further a radius size R1 which defines the opening 17 is smaller than an outer diameter size of the diaphragm 3. The outer shape of the first reflection member 11 is not limited to a square and may be a circular shape or a polygon.

The first reflection member 11 has a substrate which is formed by processing a member which has a predetermined thickness. Therefore, the concave shape annular concave surface 16 can be formed at a rear surface side of the convex shaped annular conical surface 15. In the present embodiment, a cross-sectional curve which defines the annular conical surface 15 and the annular concave surface 16 is an almost straight line. Further, the first reflection member 11 which has the annular conical surface 15 becomes an almost truncated cone shape as a top part of a cone shape is cut in view from the speaker unit 2, and becomes a shape that the opening 17 which ventilates to the annular concave surface 16 side which is at a rear surface side is provided at a place of the cut top part.

On the other hand, the second reflection member 12 has an almost conical shaped substrate which has a conical surface 18 that a Z axis which is a center axis passes a vertex of the conical surface 18. In the second reflection member 12, the vertex of the cone shape is arranged at a lower side which is near to the diaphragm 3 of the speaker unit 2 and the opening 17 of the first reflection member 11, and a flat surface 19 that an outer diameter size R2 defines is arranged at an upper side which is far from the diaphragm 3. In the present embodiment, a cross-sectional curve which defines the conical surface 18 is an almost straight line, and is a straight line which is not parallel to a straight line which defines a sectional surface of the annular conical surface 15 and the annular concave surface 16. An outer diameter size R2 which defines the flat surface 19 is at least set to larger than a radius size R1 which defines the opening 17 of the first reflection member 11. An opening is not provided at the conical surface 18 of the cone shape.

In the diffuser 10 of the present embodiment, as illustrated in FIG. 1 and FIG. 2, the first reflection member 11 and the second reflection member 12 are connected by the connection member 13 and arranged so that one part of the second reflection member 12 fits in a concave shaped space that the annular concave surface 16 of the first reflection member 11 defines. Concretely, the first reflection member 11 and the second reflection member 12 are close each other so that a vertex of the conical surface 18 of the second reflection member 12 faces to the opening 17 of the first reflection member 11. However, the second reflection member 12 does not close the opening 17 of the first reflection member 11.

The diffuser 10 is connected to an upper surface side of the cabinet 9 to which the speaker unit 2 is mounted by the connection member 14. Therefore, the diffuser 10 forms a first acoustic passage 21 that sound waves propagate and which radiates sound waves to an outer diameter direction between the diaphragm 3 of the speaker unit 2 and the annular conical surface 15 of the first reflection member 11. The first acoustic passage 21 is also formed by an upper surface side of the cabinet 9 and the annular conical surface 15 of the first reflection member 11. In the first acoustic passage 21, the larger a radius from a center axis Z becomes, the larger a cross sectional area changes to become.

Further, the diffuser 10 forms a second acoustic passage 22 that sound waves which passes the opening 17 of the first reflection member 11 propagate and which radiates sound waves to an outer diameter direction between the annular concave surface 16 of the first reflection member 11 which is arranged close to the diffuser 10 and the conical surface 18 of the second reflection member 12. In the second acoustic passage 22, the larger a radius from a center axis Z becomes, the larger a cross sectional area changes to become.

Namely, as illustrated in FIG. 2, when a separation distance in a direction which is along to a center axis of the annular concave surface 16 of the first reflection member 11 and the conical surface 18 of the second reflection member 12 is Z0, the separation distance Z0 changes depending on a radius from the center axis Z. Since a cross-sectional curve which defines the conical surface 18 of the second reflection member 12 is a straight line and a cross-sectional curve which defines the annular concave surface 16 of the first reflection member 11 is a straight line in which an angle is different from an angle of the cross-sectional curve which defines the conical surface 18, a separation distance which is defined in a direction which is along to a center axis is set not to be an equal distance. As a result, in the second acoustic passage 22, the separation distance Z0 is not an equal distance. The larger a radius from the center axis Z becomes, the larger the separation distance Z0 changes to become.

The speaker 1 of the present embodiment reproduces an audio by synthesizing sound waves which passes the first acoustic passage 21 of the diffuser 10 and is radiated and sound waves which passes the second acoustic passage 22 and is radiated.

In the full range type electrodynamic type speaker unit 2 which reproduces all bands, both of sound waves of low frequency that wavelength is long and sound waves of high frequency that wavelength is short are radiated from the vibrated diaphragm 3 and the dust cap 4. However, in the actual electrodynamic type speaker unit 2, in middle and low sound band, the diaphragm 3 and the dust cap can make the speaker unit 2 almost piston-vibrate. However, since the diaphragm 3 division-vibrates in middle and high sound band, a center part of the diaphragm 3 and the dust cap 4 mainly contribute to radiation of sound waves of middle and high sound band.

Therefore, in the diffuser 10 of the present embodiment, the first reflection member 11 in which an outer diameter size is larger than an outer diameter size of the diaphragm 3 realizes nondirectional characteristics by reflecting sound waves of low frequency that wavelength is relatively short. On the other hand, since the opening 17 of a radius size R1 which is smaller than an outer diameter size of diaphragm 3 is provided at the reflection member 11 which is close to the diaphragm 3, sound waves of relative middle and high sound band which is radiated from a center part of the diaphragm 3 and the dust cap 4 realizes nondirectional characteristics by passing the opening 17 of the first reflection member 11 and reflecting to the second reflection member 12.

In a conventional speaker (not illustrated) including a single diffuser (not illustrated) which tries to realize nondirectional characteristics, a large peak is easy to appear on sound pressure frequency characteristics by resonance which is easy to generate in a space between a diaphragm of a speaker and a diffuser.

However, in the speaker 1 including the diffuser 10 of the present embodiment, since the opening 17 of the first reflection member 11 faces to a space 20 between the diaphragm 3 of the speaker unit 2 and the diffuser 10, resonance can be hard to generate. As a result, nondirectional characteristics of middle and low sound band can be realized so that a large peak does not appear on sound pressure frequency characteristics and further, nondirectional characteristics of middle and high sound band can be also realized.

Further, in the diffuser 10 of the present embodiment, sound waves which passes the second acoustic passage 22 and are radiated are radiated to a direction which is upper than a horizontal direction. Therefore, directional characteristics can be broad in not only a horizontal direction but also a vertical direction.

Preferably, in the diffuser 10, a radius size R1 of the opening 17 of the first reflection member 11 may be smaller than an outer diameter size of the diaphragm 3 and an outer diameter size R2 which defines the flat surface 19 of the second reflection member 12 may be larger than a radius size R1. Further, the diffuser 10 may be arranged so that at least one part of the second reflection member 12 fits in a concave shaped space which the annular concave surface 16 defines of the first reflection member 11.

In the diffuser 10 of the present embodiment, each of cross-sectional curves which define the annular conical surface 15 and the annular concave surface 16 of the first reflection member 11 and the conical surface 18 of the second reflection member 12 is an almost straight line. However, these cross sectional surfaces of reflection surfaces may be configured to be defined by a plurality of continuous straight lines or curves which nonlinearly change. If a separation distance Z0 which is defined in a direction which is along to a center axis is set not to be an equal distance and the larger a radius from the center axis Z becomes, the larger cross-sectional area of the first acoustic passage 21 and the second acoustic passage 22 changes to become, the other cross-sectional curves may be suitable.

Further, since the first acoustic passage 21 is formed by the mounting surface 9*a* of the upper surface side of the cabinet 9 and the annular conical surface 15 of the first reflection member 11, in order to appropriately control reflection of sound waves in the first acoustic passage 21, for example, as illustrated in the first acoustic passage 21 of a right side of FIG. 1, a sound absorbing member 23 may be mounted to the annular conical surface 15 of the first reflection member 11 or the mounting surface 9*a* of the upper surface side of the cabinet 9. The sound absorbing member 23 may be mounted to at least any one of the annular conical surface 15 of the first reflection member 11 and the mounting surface 9*a* of the upper surface side of the cabinet 9.

Further, in the speaker 1 of the present embodiment, the diffuser 10 is connected to the speaker unit 2 via the cabinet 9. However, the diffuser 10 and the speaker unit 2 including the diaphragm 3 may be directly connected to face each other. Further, if the diaphragm 3 which is included in the electrodynamic type speaker unit 2 is a cone shape which forms a concave surface, in a shape of the dust cap 4, a convex shape is suitable as the present embodiment. However, for example, the other shape including a concave surface or the other shape which is called a double cone may be suitable.

Further, in the speaker 1 of the present embodiment, the diffuser 10 is provided at the full range type speaker unit 2. However, the diffuser 10 may be provided at the speaker unit 2 such as a woofer, a squawker, a tweeter or the like which is suitable for reproduction of specific frequency band. The speaker 1 is composed as a multiway speaker system that a plurality of speaker units is combined and the diffuser 10 may be mounted to face to a diaphragm of each of speaker units.

Embodiment 2

Figure 3:
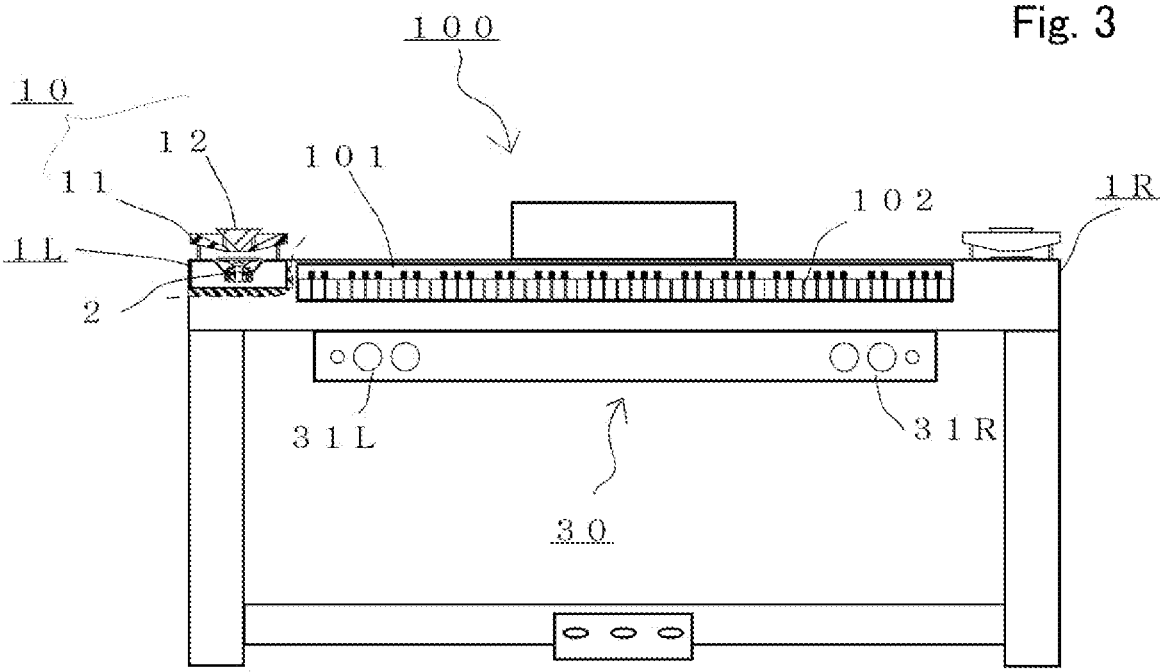
FIG. 3 is a front diagram for describing an electronic musical instrument according to one embodiment of the present disclosure.

FIG. 3 is a diagram for describing an electronic musical instrument according to a preferable embodiment of the present disclosure. Concretely, FIG. 3 is a front diagram (partial cross sectional diagram) of an electronic piano 100 including the speaker 1 including the diffuser 10 of the above described embodiment as a left speaker 1L and a right speaker 1R. A configuration of the electronic piano 100 is not limited to a case of the present embodiment. With regard to an unnecessary configuration of the electronic piano 100 for description of the present disclosure, illustration and description are omitted.

When a player operates keyboards 102 which are operators which are provided at an enclosure 101 of the electronic piano 100, the electronic piano 100 is an electronic musical instrument which reproduces performance sound by outputting an audio signal corresponding to a keyboard from a sound source circuit (not illustrated), and amplifying the performance sound and outputting the amplified performance sound to a speaker. This electronic piano 100 includes the speakers 1L and 1R which are mounted to left and right of an upper surface side of the keyboards 102 of the enclosure 101 and a speaker 30 which is mounted to a lower surface side of the keyboards 102 of the enclosure 101 as speakers.

Each of the speakers 1L and 1R includes the diffuser 10 of the above described embodiment and the diffuser 10 includes the first reflection member 11 and the second reflection member 12 as described above. In the speaker unit 2 which is included in the speakers 1L and 1R, the diaphragm 3 vibrates to a vertical direction. The speaker 1L corresponds to a left audio signal of stereo reproduction and radiates performance sound to become nondirectional characteristics with regard to a horizontal direction. Further, the speaker 1R corresponds to a right audio signal of stereo reproduction and radiates performance sound to become nondirectional characteristics with regard to a horizontal direction.

Further, the speaker 30 has a wide cabinet and includes a speaker 31L corresponding to a left audio signal of stereo reproduction at a left side of the cabinet and a speaker 31R corresponding to a right audio signal of stereo reproduction at a right side of the cabinet. Since each of the speaker 31L and 31R includes a plurality of speaker units which are arranged so that a direction that a diaphragm vibrates becomes a longitudinal direction and does not especially include a diffuser or the like, each of the speakers 31L and 31R has directional characteristics that sound pressure becomes high in a longitudinal direction. Therefore, each of the speakers 31L and 31R corresponds to left or right audio signal of stereo reproduction, has directional characteristics in a longitudinal direction, and radiates performance sound. When audio frequency band that a plurality of the speaker units of each of the speakers 31L and 31R reproduce is divided, the multiway speaker system may be composed of the speaker 30.

The speaker 30 is arranged in a neighborhood of a knee of a player of the electronic piano 100 and is suitable for reproducing direct sound component of performance sound of the electronic piano 100. On the other hand, each of the speakers 1L and 1R is suitable for reproducing indirect sound component of performance sound. Balance of volume of performance sound which is reproduced from the speaker 30 and the speakers 1L and 1R can be controlled by setting of the electronic piano 100. By adopting this configuration to a speaker of the electronic piano 100, it can be expected that performance sound of the electronic piano 100 can be perceived for a player and a listener as sound which is close to performance sound of an original acoustic piano.

The electronic piano 100 may only include the speakers 1L and 1R and may not include the speaker 30. In that case, the speakers 1L and 1R may reproduce both of direct sound component and indirect sound component of performance sound.

The electronic piano 100 of the present embodiment is an electronic musical instrument including keyboards. However, the other electronic musical instrument may be suitable.

Embodiment 3

Figure 4:
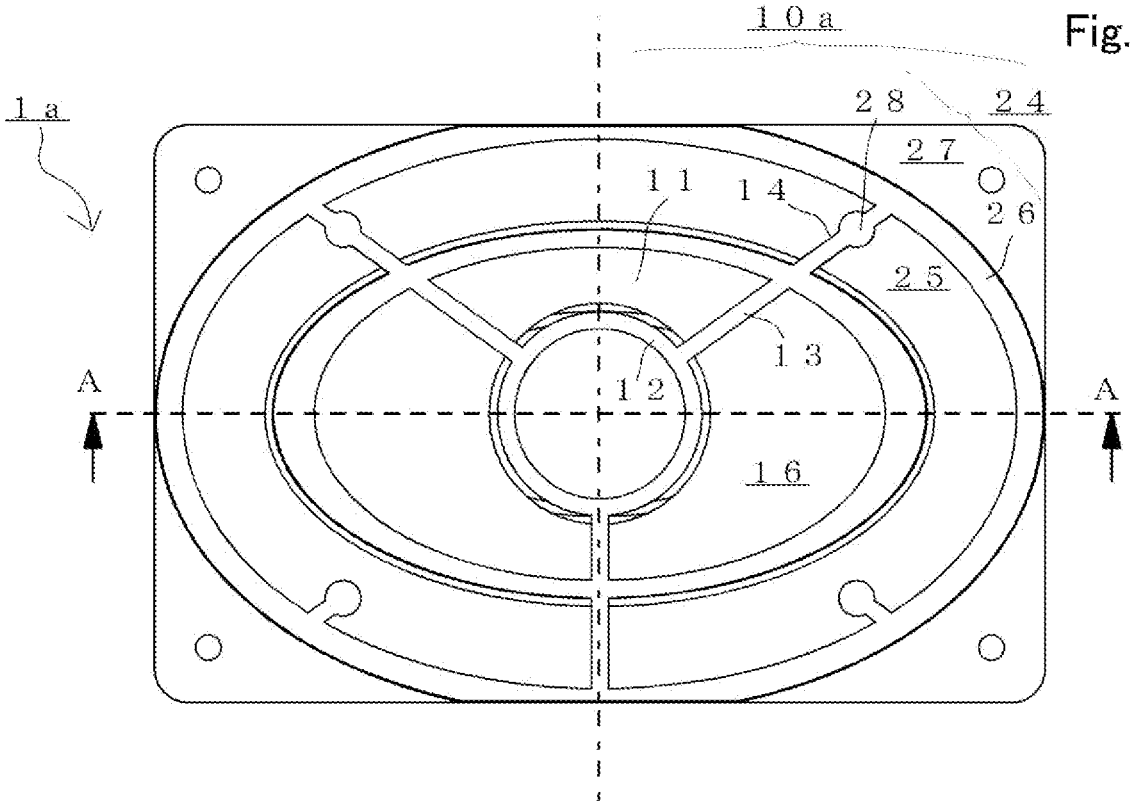
FIG. 4 is a top diagram for describing the other diffuser and a speaker including the diffuser according to one embodiment of the present disclosure.
Figure 5:
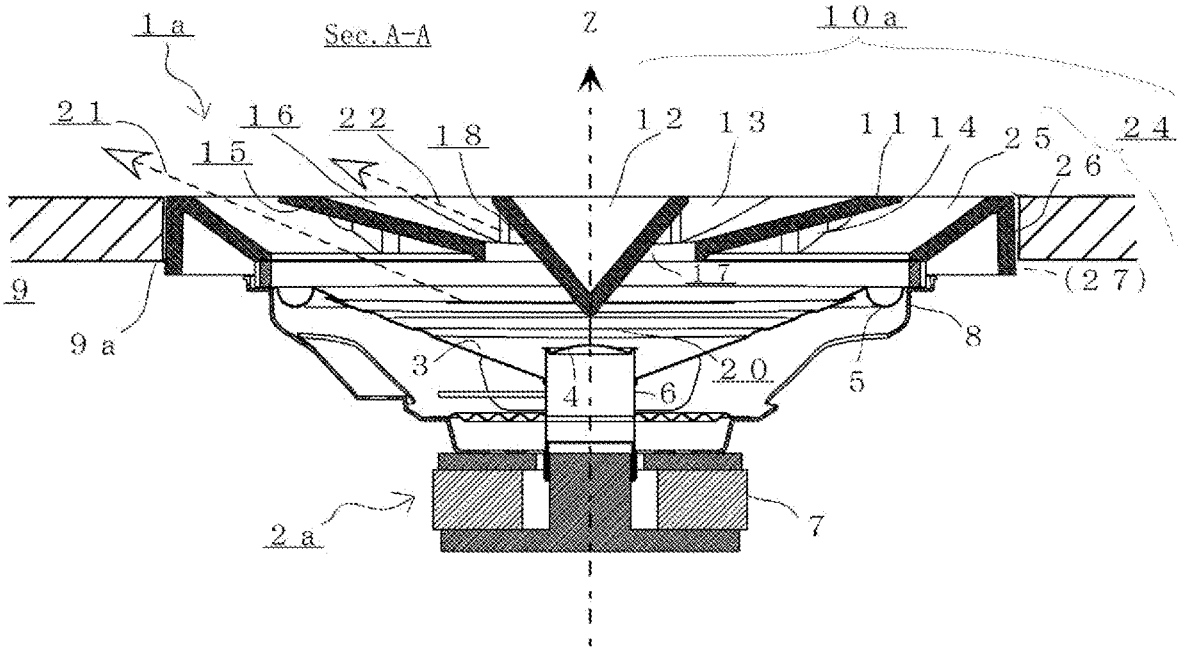
FIG. 5 is a cross sectional diagram for describing the other diffuser and the speaker including the diffuser according to one embodiment of the present disclosure.

Each of FIG. 4 and FIG. 5 is a diagram for describing a diffuser and a speaker including the diffuser according to a preferable embodiment of the present disclosure. Concretely, FIG. 4 is a top diagram of a speaker 1*a* including a diffuser 10*a* and FIG. 5 is a cross sectional diagram corresponding to A-A cross-section of FIG. 4 of the speaker 1*a* which is mounted to a mounting surface 9*a*.

The diffuser 10*a* and the speaker 1*a* include a common configuration to the diffuser 10 and the speaker 1 of the previous embodiment and a part of a configuration of the diffuser 10*a* and the speaker 1*a* is different from a configuration of the diffuser 10 and the speaker 1. Therefore, a common number is attached to a common configuration, with regard to the common configuration, description is omitted, and a different configuration is described below. With regard to an unnecessary configuration of the diffuser 10*a* and the speaker 1*a* for description of the present disclosure, illustration and description are omitted.

In the diffuser 10*a* of the present embodiment, its outer shape corresponds to a speaker unit 2*a* which includes the ellipse shaped diaphragm 3 and is configured to a rectangle and the diffuser 10*a* is mounted to the speaker unit 2*a*. Further, the speaker 1*a* includes a speaker unit 2*a* which is an electrodynamic speaker including the diaphragm 3 in which an outer diameter size is ellipse shaped and the diffuser 10*a*. These are connected and configured integrally. The speaker 1*a* is mounted to a mounting surface 9*a* of the cabinet 9 of an electronic musical instrument (not illustrated) from an inner side (a lower side in a figure).

In the first reflection member 11 of this diffuser 10*a*, the opening 17 which defines an inner diameter size of a substrate of the first reflection member 11 is circular. However, the opening 17 is different from the diffuser 10 of the previous embodiment in such point that the opening 17 corresponds to the diaphragm 3 of the ellipse shaped speaker unit 2*a* which has a long diameter direction and a short diameter direction and an outer diameter size of the substrate is defined by an ellipse shape. On the other hand, the second reflection member 12 is common in such point that the second reflection member 12 has an almost cone shaped substrate which has a conical surface 18 that a Z axis which is a center axis passes a vertex of the conical surface 18. However, in this diffuser 10*a*, a vertex of the conical surface 18 of the second reflection member 12 intrudes the opening 17 of the first reflection member 11. Further, in this second reflection member 12, in an almost cone shaped substrate, a back side of the conical surface 18 is concave shaped and a flat surface 19 that an outer diameter size R1 defines as the diffuser 1 of the previous embodiment is not formed.

The diffuser 10*a* is parts that the first reflection member 11, the second reflection member 12, the connection member 13 which connects the first reflection member 11 and the second reflection member 12, a speaker mounting member 24 which connects the speaker unit 2*a*, and the connection member 14 which connects the first reflection member 11 and the speaker mounting member 24 are molded by resin integrally. Therefore, in this diffuser 10*a*, an outer diameter size R2 of the second reflection member 12 a little smaller than a radius R1 of the opening 17 of the first reflection member 11 to divide a metal mold (not illustrated) which molds resin to two in an illustrated longitudinal direction and draw.

Further, the diffuser 10*a* is configured to include the speaker mounting member 24 and the diffuser 10*a* is designed so that its total height is low and the diffuser 10*a* does not project from the cabinet 9 to an upper side largely when the diffuser 10*a* is compared with the diffuser 10 of the previous embodiment. Concretely, the speaker mounting member 24 includes an annular concave surface 25 which forms the first acoustic passage 21 by facing to the annular conical surface 15 of the first reflection member 11 and a connection part (not illustrated) which is connected to the speaker unit 2*a* at an inner diameter part of the speaker mounting member 24. Further, the speaker mounting member 24 includes a short almost ellipse cylindrical rib shaped part 26 which extends from an outer diameter part of the annular concave surface 25 to an illustrated lower side. Further, the speaker mounting member 24 includes a flange part 27 which is formed by extending from a lower edge side of the rib shaped part 26 to a circumference side at four points.

The flange part 27 mounts the speaker 1*a* including the diffuser 10*a* and the speaker unit 2*a* to the cabinet 9 by engaging with an edge part of an opening part which is provided at the mounting surface 9*a* of an upper surface side of the cabinet 9 from an lower side. Since height of the annular concave surface 25 and the rib shaped part 26 almost defines total height size of the speaker mounting member 24, total height relatively becomes low and the diffuser 10*a* does not project from the mounting surface 9*a*. There is a merit that the speaker 1*a* including the diffuser 10*a* does not become conspicuous and limitation on product design of an electronic musical instrument which is mounted becomes small.

The diffuser 10*a* forms the first acoustic passage 21 that sound waves propagate and which radiates sound waves to an outer diameter direction between the diaphragm 3 of the speaker unit 2*a* and the annular concave surface 25 of the speaker mounting member 24 and the annular conical surface 15 of the first reflection member 11. Further, the diffuser 10*a* forms the second acoustic passage 22 that sound waves which passes the opening 17 of the first reflection member 11 and which radiates sound waves to an outer diameter direction between the annular concave surface 16 of the first reflection member 11 which is arranged close and the conical surface 18 of the second reflection member 12. Further, since large peak does not appear on sound pressure frequency characteristics, nondirectional characteristics of middle and low sound band can be realized and nondirectional characteristics of middle and high sound band can be also realized, further.

Figure 6:
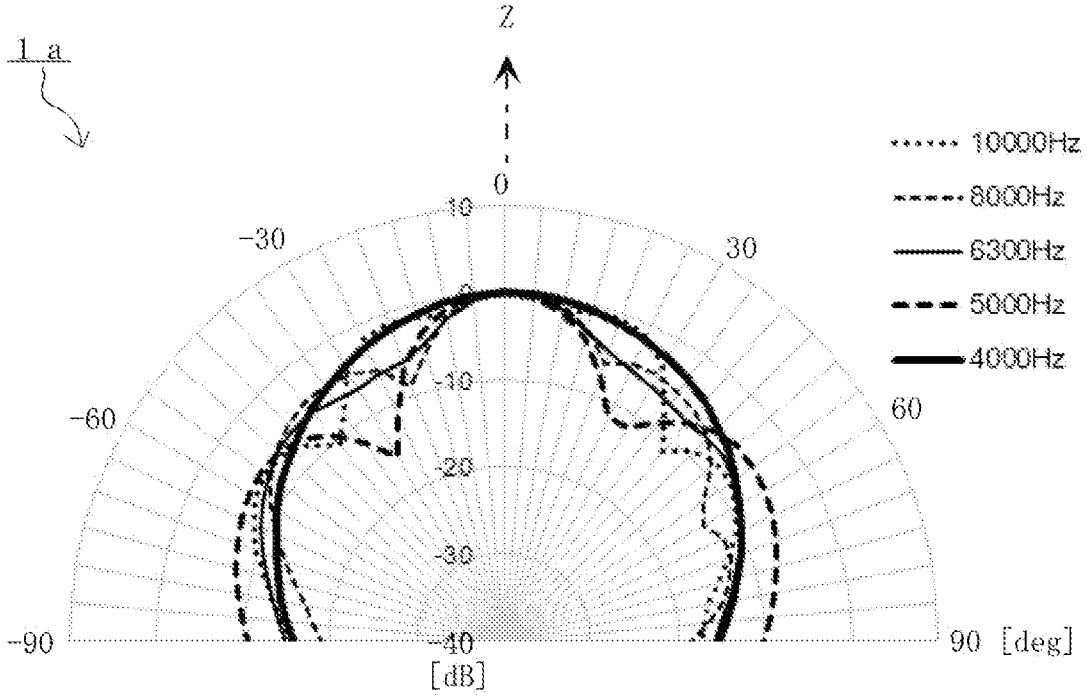
FIG. 6 is a graph for describing directional characteristics of the speaker including the other diffuser according to one embodiment of the present disclosure.

FIG. 6 is a graph for describing directional characteristics of the speaker 1*a* including the diffuser 10*a* of the present embodiment. Further, FIG. 7 is a graph for describing directional characteristics of a speaker 100 (not illustrated) including a diffuser 100*a* (not illustrated) of a comparison example.

Concretely, the diffuser 100*a* of the speaker 100 of the comparison example is substantially different from the diffuser 10*a* in such point that the first reflection member 11 is removed and includes the same speaker unit 2*a*. Therefore, graphs of FIG. 6 and FIG. 7 indicate difference of the diffuser 10*a* of the present embodiment and the diffuser 100*a* of the comparison example.

Figure 7:
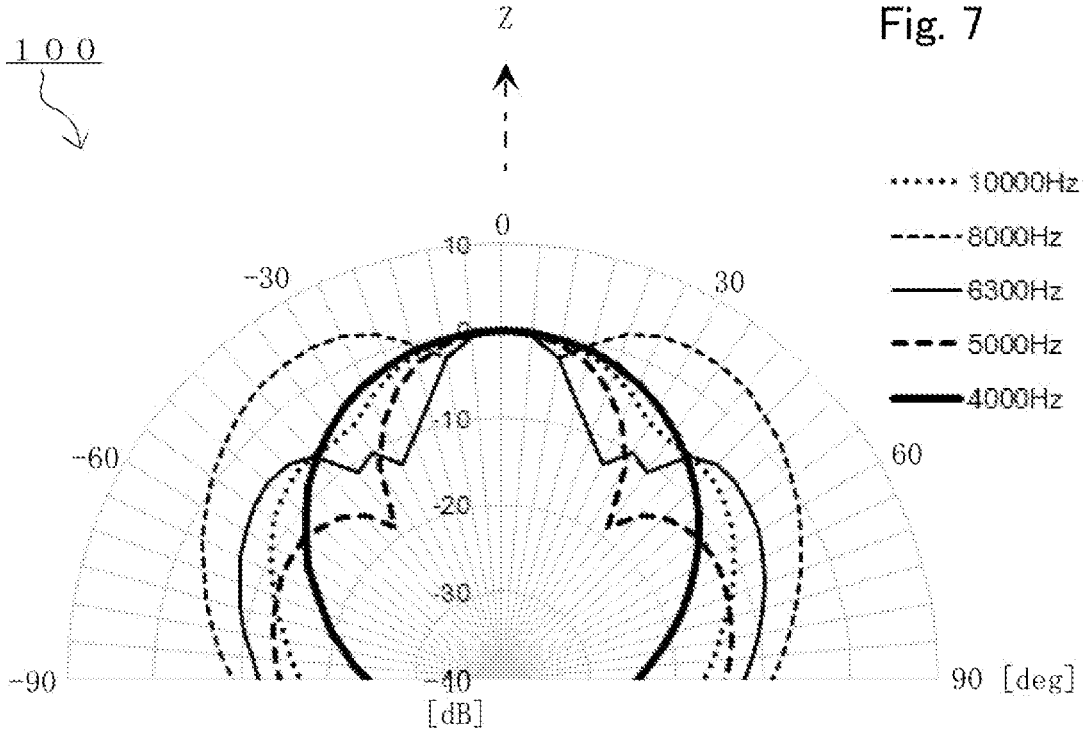
FIG. 7 is a graph for describing directional characteristics of a speaker including a diffuser of a comparison example.

Graphs of directional characteristics of FIG. 6 and FIG. 7, a Z axis direction of FIG. 5 is a directional angle: a direction of 0 degrees, sound pressure of each directional angle (−90 degrees to 90 degrees) which is standardized by sound pressure level in this Z axis direction is displayed by polar coordinate, and directional characteristics are indicated. Graphs of each frequency of 4 kHz, 5 kHz, 6.3 kHz, 8 kHz, and 10 kHz are overwritten. As a result, graphs of FIG. 6 and FIG. 7 illustrate a state which radiates with nondirectional characteristics with regard to a horizontal direction which is orthogonal to an upper surface direction and a Z axis of the mounting surface 9*a*.

As understood by comparing graphs of FIG. 6 and FIG. 7, with regard to nonuniformity of directional characteristics by each frequency, the speaker 1*a* including the diffuser 10*a* of the present embodiment of FIG. 6 is smaller than the speaker 100 including the diffuser 100*a* of the comparison example of FIG. 7. In case of the diffuser 10*a*, increase and decrease of sound pressure by a directional angle can be smaller than the diffuser 100*a*.

The diffuser 10*a* includes a mounting member 28 which mounts a grill member (not illustrated) or the like which includes a frame part which puts up a punching member which has breathability or a net which has breathability at the connection member 14 and the speaker mounting member 24. Since the grill member is mounted to cover the first acoustic passage 21 and the second acoustic passage 22, the grill member prevents that an foreign object, a hand of a user or the like enter into the first acoustic passage 21 or the second acoustic passage 22 and can protect the diaphragm 3 of the speaker unit 2*a*.

Further, an outer shape of the diffuser 10*a* may be a circular shape or a rectangular shape to correspond to the other speaker unit 2 including the diaphragm 3 of a circular shape. Further, in the diffuser 10*a*, in the speaker mounting member 24, it is not necessary that the rib shaped part 26 is necessarily provided and the flange part 27 may be extended from an outer diameter part of the annular concave surface 25 to a circumference side. In that case, the flange part 27 may mount the speaker 1*a* including diffuser 10*a* and the speaker unit 2*a* to the cabinet 9 by engaging with an edge part of the opening part which is provided at the mounting surface 9*a* of the cabinet 9 from an upper side.

Embodiment 4

Figure 8:
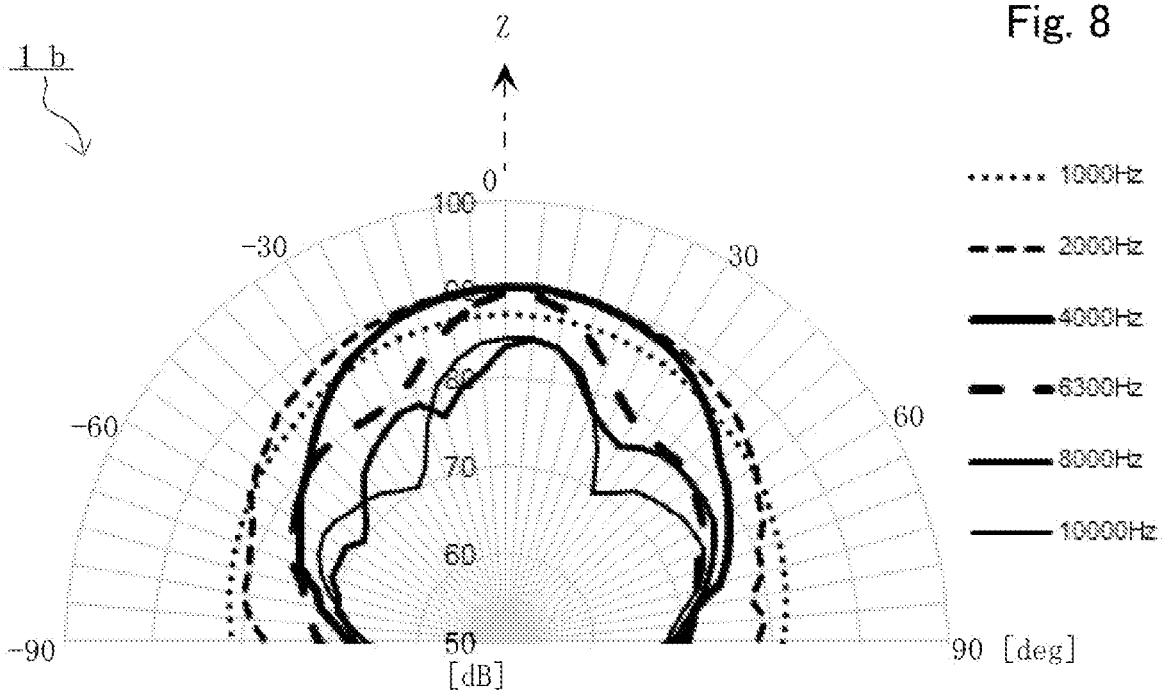
FIG. 8 is a graph for describing directional characteristics of a speaker including the other diffuser according to one embodiment of the present disclosure.
Figure 9:
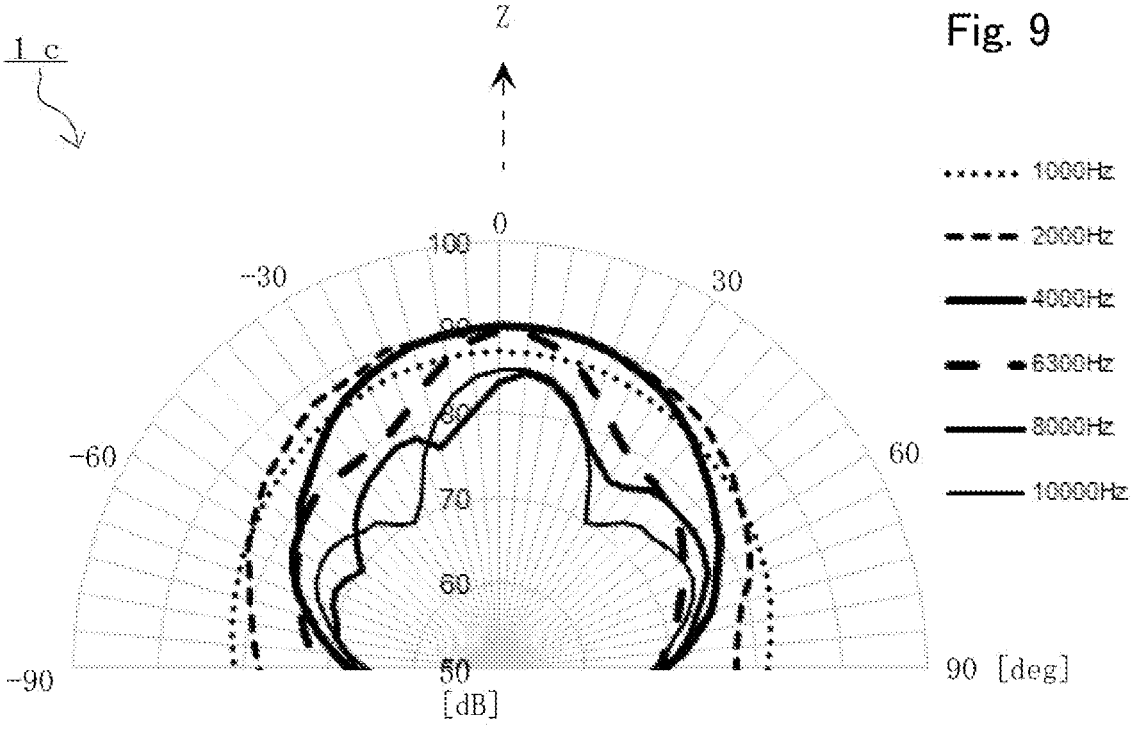
FIG. 9 is a graph for describing directional characteristics of the speaker including the other diffuser according to one embodiment of the present disclosure.

FIG. 8 is a graph for describing directional characteristics of a speaker 1*b* (not illustrated) including a diffuser 10*b* (not illustrated) of the present embodiment. Further, FIG. 9 is a graph for describing directional characteristics of a speaker 1*c* (not illustrated) including a diffuser 10*c* (not illustrated) of the present embodiment.

The diffuser 10*b* and speaker 1*b* and the diffuser 10*c* and speaker 1*c* of the present embodiment includes a common configuration to the diffuser 10 and speaker 1 of the previous embodiment, while, in the diffuser 10*b* and speaker 1*b* and the diffuser 10*c* and speaker 1*c* of the present embodiment, an outer diameter size of the first reflection member 11 is different from the diffuser 10 and speaker 1 of the previous embodiment. Therefore, a common number is attached to a common configuration, with regard to the common configuration, description is omitted, a different configuration is described below, and illustration and description are omitted.

In the present embodiment, the speaker unit 2*b* (not illustrated) is common, and an outer diameter size of a diaphragm 3*b* (not illustrated) is 108.8 mm. An outer diameter size of the diaphragm 3*b* is an outer diameter size which does not include an edge 5*b* (not illustrated). However, in some instances, the outer diameter size may include the edge 5*b*.

In the diffuser 10*b* of the present embodiment of the graph of FIG. 8, an outer diameter size of the first reflection member 11 is 114.0 mm and is larger than an outer diameter size 108.8 mm of the diaphragm 3*b*. On the other hand, in the diffuser 10*c* of the present embodiment of the graph of FIG. 9, an outer diameter size of the first reflection member 11 is 104.0 mm and is smaller than an outer diameter size 108.8 mm of the diaphragm 3*b*. However, when comparing FIG. 8 and FIG. 9, a significant difference is not seen. Namely, the diffusers 10*b* and 10*c* of the present embodiment have almost the same directional characteristics.

Therefore, in the diffuser 10*b* or 10*c* of the present embodiment, the first reflection member 11 in which an outer diameter size is not larger than an outer diameter of the diaphragm 3*b* can realize nondirectional characteristics by reflecting sound waves of low frequency that wavelength is relatively long. An outer diameter size of the first reflection member 11 of the diffuser 10*b* or 10*c* may be the same extent as an outer diameter size of the diaphragm 3*b* of the speaker unit 2*b* and may not be necessarily larger than an outer diameter size of the diaphragm 3*b*.

In the speaker 1*b* or 1*c* including the diffuser 10*b* or 10*c* of the present embodiment, since the opening 17 of the first reflection member 11 faces to a space 20 between the diaphragm 3*b* of the speaker unit 2*b*, resonance can be hard to generate. As a result, nondirectional characteristics of middle and low sound band can be realized so that a large peak does not appear on sound pressure frequency characteristics and nondirectional characteristics of middle and high sound band can be also realized further.

Embodiment 5

Figure 10:
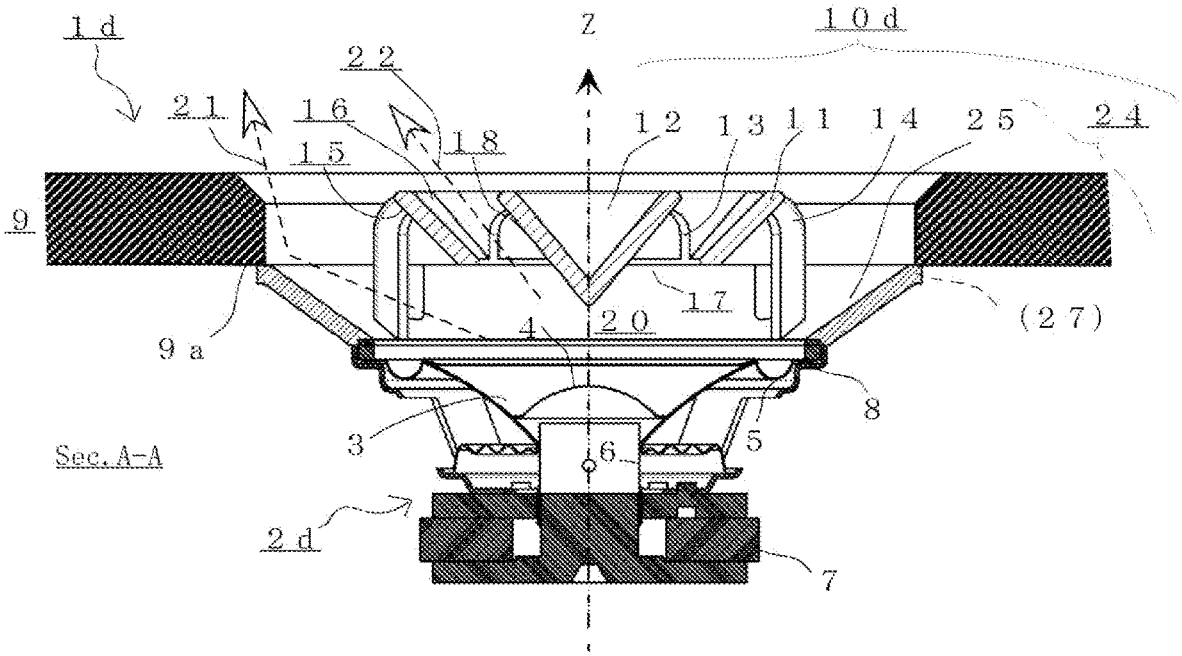
FIG. 10 is a sectional diagram for describing the other diffuser and the speaker including the diffuser according to one embodiment of the present disclosure.

FIG. 10 is a diagram for describing a diffuser according to the other preferable embodiment of the present disclosure and a speaker including the diffuser. FIG. 10 is a cross sectional diagram of the speaker 1*d* which includes a diffuser 10*d* and is mounted to the mounting surface 9*a* of an inner surface side of the cabinet 9.

In the diffuser 10*d* and the speaker 1*d* of the present embodiment, one part of a configuration is different from the diffuser 10*a* and the speaker 1*a* of the previous embodiment, while the diffuser 10*d* and the speaker 1*d* have a common configuration. Therefore, a common number is attached to a common configuration, with regard to the common configuration, description is omitted, a different configuration is described below. With regard to a configuration of the unnecessary diffuser 10*d* and the speaker 1*d* for description of the present disclosure, illustration and description are omitted.

Further, the diffuser 10*d* of the present embodiment is configured to include the speaker mounting member 24 similarly to the diffuser 10*a* of the previous embodiment. However, the diffuser 10*d* is different from the diffuser 10*a* in such point that the speaker mounting member 24 does not include a short almost ellipse cylindrical rib shaped part 26 which extends from an outer diameter part of the annular concave surface 25 to an illustrated lower side when comparing with the diffuser 10*a* of the previous embodiment.

Namely, since the speaker mounting member 24 includes the flange part 27 which extends at a circumference side in four points of a diameter direction and is formed, the speaker mounting member 24 can be mount the speaker 1*d* including the diffuser 10*d* and the speaker unit 2*d* to the cabinet 9 by engaging with an edge part of an opening part which is provided at the mounting surface 9*a* of the cabinet 9 inside from a lower side.

The diffuser 10*d* forms the first acoustic passage 21 that sound waves propagate and which radiates sound waves to an outer diameter direction between an annular concave surface 25 of the diaphragm 3 of the speaker unit 2*d* and the speaker mounting member 24 and the opening part of the mounting surface 9*a* and the annular conical surface 15 of the first reflection member 11. Further, the diffuser 10*d* forms the second acoustic passage 22 that sound waves which pass the opening 17 of the first reflection member 11 propagate and which radiates sound waves to an outer diameter direction between the annular concave surface 16 of the first reflection member 11 and the conical surface 18 of the second reflection member 12 which are arranged close. Therefore, nondirectional characteristics of middle and low sound band can be realized so that a large peak does not appear on sound pressure frequency characteristics and nondirectional characteristics of middle and high sound band can be also realized further.

A diffuser of the present disclosure is not limited to an electrodynamic type speaker unit as illustrated and may be a speaker unit which includes a piezoelectric type, an electrostatic type, or an electromagnetic type driving section and has a diaphragm further.

What is claimed is:

1. A diffuser which is arranged to face to a diaphragm of a speaker which radiates sound waves comprising:

an opening that a center axis which defines a direction the diaphragm vibrates passes and which defines an inner diameter size;

an almost truncated cone shaped first reflection member which has an annular conical surface which faces to the diaphragm and an annular concave surface which is formed at an opposite side of the annular conical surface, and;

an almost cone shaped second reflection member which is arranged close to the first reflection member and has a conical surface that the center axis passes a vertex of the conical surface, wherein the diffuser forms a first acoustic passage that the sound waves propagate and which radiates the sound waves to an outer diameter direction between the diaphragm and the annular conical surface of the first reflection member and forms a second acoustic passage the sound waves which pass the opening of the first reflection member propagate and which radiates the sound waves to an outer diameter direction between the annular concave surface of the first reflection member and the conical surface of the second reflection member.

2. The diffuser according to claim 1, wherein an outer diameter size of the first reflection member is larger than an outer diameter size of the diaphragm.

3. The diffuser according to claim 1, wherein an outer diameter size of the second reflection member is large than the inner diameter size of the opening of the first reflection member.

4. The diffuser according to claim 1, wherein the first reflection member and the second reflection member are arranged so that at least one part of the second reflection member fits in a concave shaped space that the annular concave surface of the first reflection member defines.

5. The diffuser according to claim 1, wherein a separation distance which is defined in a direction which is along to a cross-sectional curve which defines the annular concave surface of the first reflection member and the center axis is set not to be an equal distance in the cross-sectional curve which defines the conical surface of the second reflection member.

6. The diffuser according to claim 1 further comprising:

a connection member which connects the first reflection member and the second reflection member to form the second acoustic passage.

7. The diffuser according to claim 6 further comprising:

a speaker mounting member which mounts the diaphragm of the speaker by facing to the annular conical surface of the first reflection member and arranging to form the first acoustic passage, and;

a connection member which connects the first reflection member and the speaker mounting member.

8. The diffuser according to claim 1 further comprising:

a grill member which is formed by a member which has breathability and provide at the first acoustic passage and/or the second acoustic passage.

9. The diffuser according to claim 1, wherein the inner diameter size of the first reflection member and the outer diameter size of the second reflection member are defined by a circular shape and the outer diameter size of the first reflection member is defined by an ellipse shape.

10. A speaker at least comprising:

the diffuser according to any one of claim 1; and the diaphragm which is arranged to face to the diffuser.

11. The speaker according to claim 10, wherein the diaphragm is a cone shape which forms a concave surface which corresponds to the annular conical surface of the first reflection member and has a convex shaped dust cap at a position which faces to the opening of the first reflection member.

12. An electronic musical instrument at least comprising:

the diffuser according to claim 1;

a speaker which at least includes the diaphragm which is arranged to face to the diffuser; and an enclosure which is mounted to the diffuser and the speaker.

13. The electronic musical instrument according to claim 12, wherein a sound absorbing member is further mounted to any one of the annular conical surface of the first reflection member and a mounting surface to which the speaker of the enclosure is mounted.

* * * * *